US011654539B2

(12) United States Patent
Ueda et al.

(10) Patent No.: US 11,654,539 B2
(45) Date of Patent: May 23, 2023

(54) DRIVING TOOL

(71) Applicant: KOKI HOLDINGS CO., LTD., Tokyo (JP)

(72) Inventors: Takashi Ueda, Ibaraki (JP); Koji Shioya, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 144 days.

(21) Appl. No.: 17/051,963

(22) PCT Filed: Apr. 26, 2019

(86) PCT No.: PCT/JP2019/017900
§ 371 (c)(1),
(2) Date: Oct. 30, 2020

(87) PCT Pub. No.: WO2019/220929
PCT Pub. Date: Nov. 21, 2019

(65) Prior Publication Data

US 2021/0316433 A1 Oct. 14, 2021

(30) Foreign Application Priority Data

May 18, 2018 (JP) ..... JP2018-095939

(51) Int. Cl.
*B25C 1/04* (2006.01)
*B25C 1/06* (2006.01)

(52) U.S. Cl.
CPC ..... *B25C 1/047* (2013.01); *B25C 1/06* (2013.01)

(58) Field of Classification Search
None
See application file for complete search history.

(56) References Cited

U.S. PATENT DOCUMENTS 2,801,417 A * 8/1957 Jenny ..... B25C 5/16 227/123
2,947,003 A * 8/1960 Ericsson ..... B25C 5/16 227/126

(Continued)

FOREIGN PATENT DOCUMENTS

JP 2003-071741 A 3/2003
JP 2015-047652 A 3/2015

(Continued)

OTHER PUBLICATIONS

International Search Report issued in corresponding International Patent Application No. PCT/JP2019/017900, dated Jun. 25, 2019, with English translation.

*Primary Examiner* — Nathaniel C Chukwurah
*Assistant Examiner* — Tanzim Imam
(74) *Attorney, Agent, or Firm* — McDermott Will & Emery LLP

(57) ABSTRACT

Nail jamming in a driving tool is easily solved. The driving tool includes: a striking driver configured to drive a driver blade that strikes a fastener; a first blade guide fixed to a main body having the striking driver; and a second blade guide attached to the first blade guide and configured to form an injection path for the fastener together with the first blade guide. The driver blade is arranged so as to go through a space made of two opposite side walls of the injection path, a top wall and a bottom wall, and either one of the two side walls, is separated from the injection path when the first blade guide and the second blade guide are separated from each other.

8 Claims, 12 Drawing Sheets

(56) References Cited

U.S. PATENT DOCUMENTS

| | | | | | |
|---|---|---|---|---|---|
| 2,954,561 | A * | 10/1960 | Starr | B25C 1/041 | 227/120 |
| 5,368,213 | A | 11/1994 | Massari, Jr. | | |
| 2009/0026244 | A1 * | 1/2009 | Huang | B25C 1/005 | 227/119 |
| 2009/0072002 | A1 * | 3/2009 | Ishizawa | B25C 5/1665 | 227/120 |

FOREIGN PATENT DOCUMENTS

| | | | | |
|---|---|---|---|---|
| JP | 2018-034258 | A | 3/2018 | |
| WO | WO-2016174994 | A1 * | 11/2016 | B25C 1/041 |

* cited by examiner

21: DRIVER BLADE
40: INJECTION PATH
40a, 40b: SIDE WALL
40c: TOP WALL
40d: BOTTOM WALL
41: FIRST BLADE GUIDE
42: SECOND BLADE GUIDE
46: SPACE

DRIVING TOOL

CROSS REFERENCE TO RELATED APPLICATIONS

This application is the U.S. National Phase under 35 US.C. § 371 of International Application No. PCT/JP2019/017900, filed on Apr. 26, 2019, which claims the benefit of Japanese Application No. 2018-095939, filed on May 18, 2018, the entire contents of each are hereby incorporated by reference.

TECHNICAL FIELD

The present invention relates to a driving tool that strikes a fastener by using a driver blade.

BACKGROUND ART

Among driving tools each of which moves a driver blade and strikes a fastener by using the driver blade, pneumatic-type driving tools have been known, the pneumatic-type driving tool driving the driver blade for shot by further compressing air of a pressure chamber in a main body due to the movement of the driver blade and releasing the compressed air.

A configuration of the pneumatic-type driving tool as described above is disclosed in, for example, a Patent Document 1, and the Patent Document 1 discloses a driving tool in which a load on a convex portion of the driver blade is reduced.

RELATED ART DOCUMENT

Patent Document

Patent Document 1: Japanese Patent Application Laid-Open Publication No. 2018-34258

SUMMARY OF THE INVENTION

Problems to be Solved by the Invention

In the pneumatic-type driving tool, the compressed air filling the pressure chamber is sealed by a highly airtight sealing structure, and the pneumatic-type driving tool includes: a cylindrical cylinder at one end of the pressure chamber; and a driver blade capable of storing compressed energy by sliding inside this cylindrical cylinder in an axial direction. And, when the compressed energy is released, the fastener is driven (tucked) by the driver blade.

At the driving, a head of a nail that is loaded in an injection path at an end of the driver blade is driven into a wood piece or others while being pushed. At this time, in the driving tool, generally, there is a case of occurrence of nail jamming in which the nail is jammed in an injection port. The larger a driving energy is, the larger a necessary power for solving the nail jamming is, and therefore, a lot of time and effort for solving the nail jamming are needed so often. Further, in the pneumatic-type driving tool, the driver blade is urged by the internal compressed air even in the nail jamming, and therefore, the time and effort for solving the nail jamming tends to increase.

At the time of the nail jamming, the nail is jammed in a gap between a side wall of the driver blade and a side wall of a concave portion of a blade guide that guides the driver blade, and the driver blade does not move, either. Therefore, there is an issue of difficulty in solving the nail jamming.

A purpose of the present invention is to easily solve the nail jamming in the driving tool.

Means for Solving the Problems

A driving tool of the present invention includes: a striking driver configured to drive a driver blade that strikes a fastener; a main body having the striking driver; a first blade guide fixed to the main body; and a second blade guide attached to the first blade guide and configured to form an injection path for the fastener together with the first blade guide. And, the driver blade is arranged so as to go through a space made of two opposite side walls of the injection path, a bottom wall and a top wall, and either one of the two side walls is separated from the injection path.

Effects of the Invention

According to the present invention, the nail jamming in the driving tool can be easily solved.

BRIEF DESCRIPTIONS OF THE DRAWINGS

BEST MODE FOR CARRYING OUT THE INVENTION

First Embodiment

Figure 1:
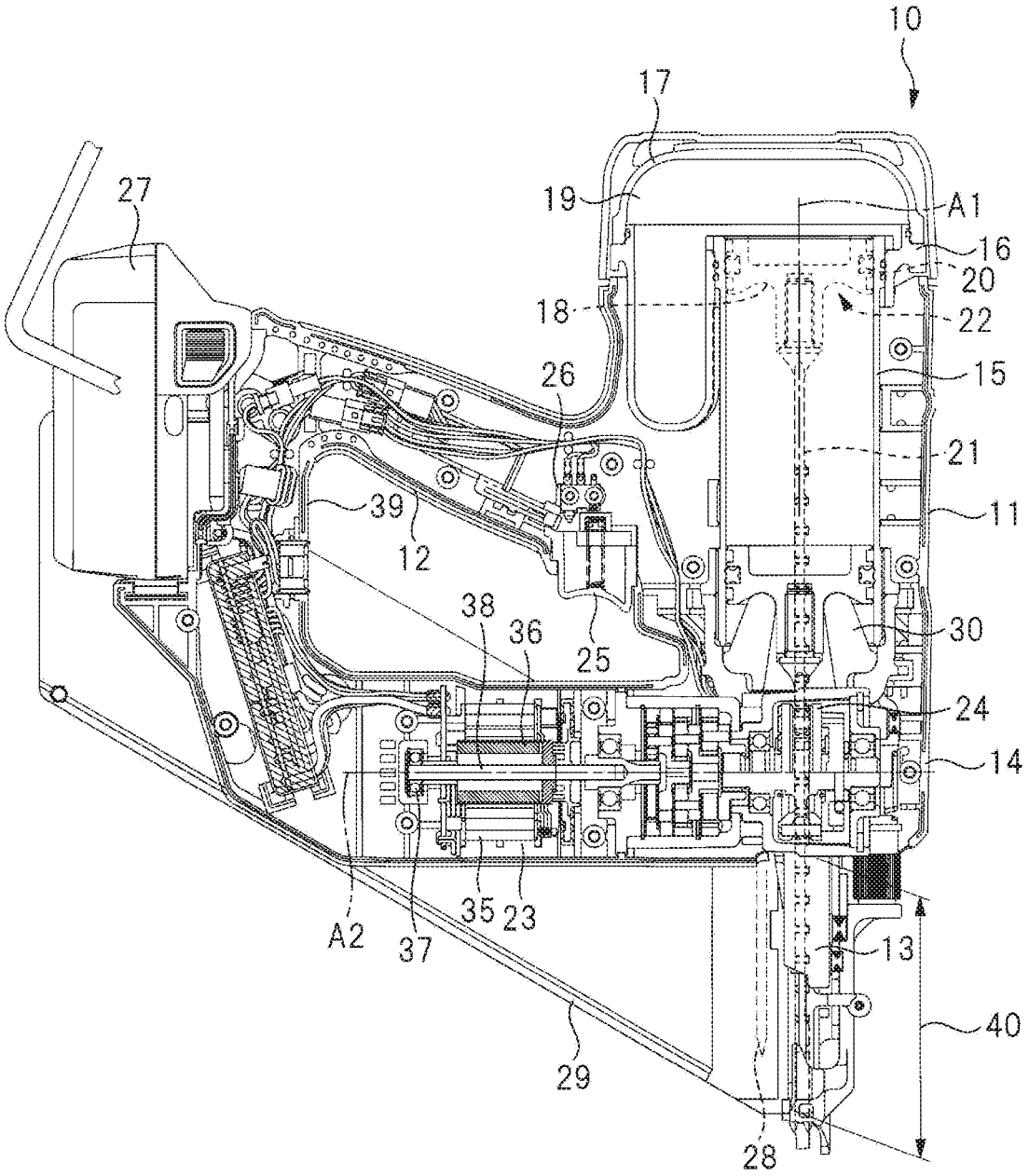
FIG. 1 is a side view showing a partially-cut internal structure of a driving tool of a first embodiment of the present invention.
Figure 2:
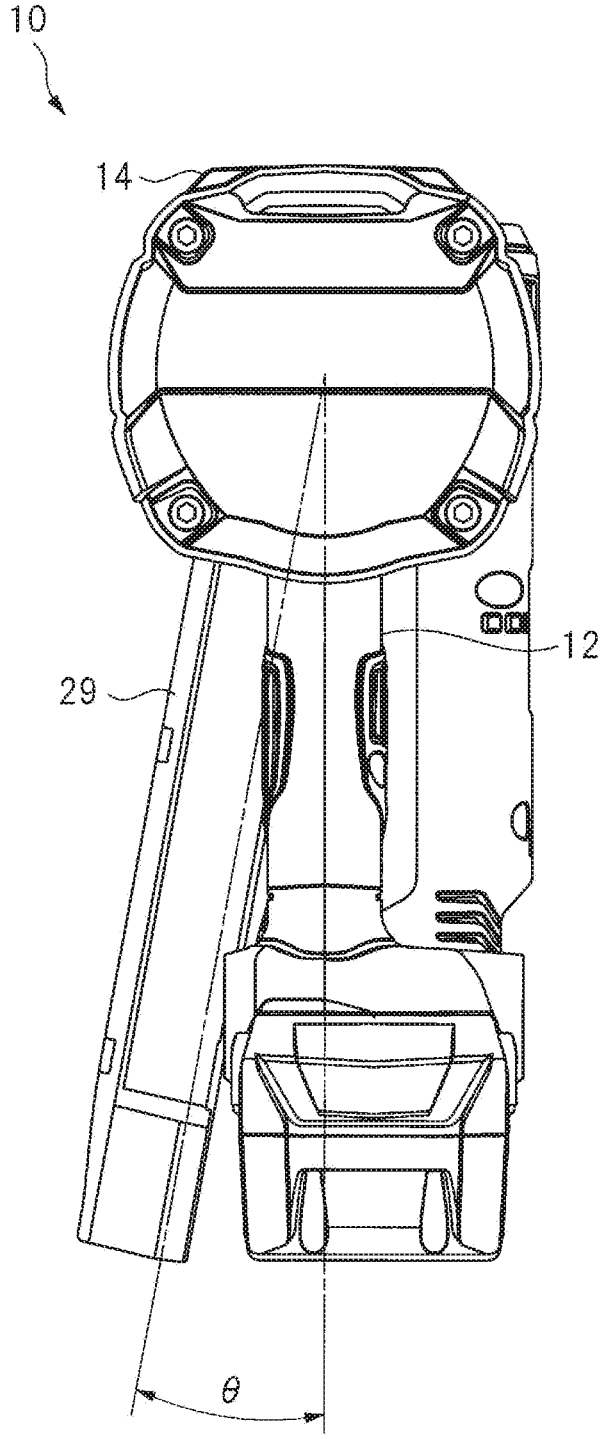
FIG. 2 is a back view showing an outer appearance structure of a back side of the driving tool shown in FIG. 1.
Figure 3:
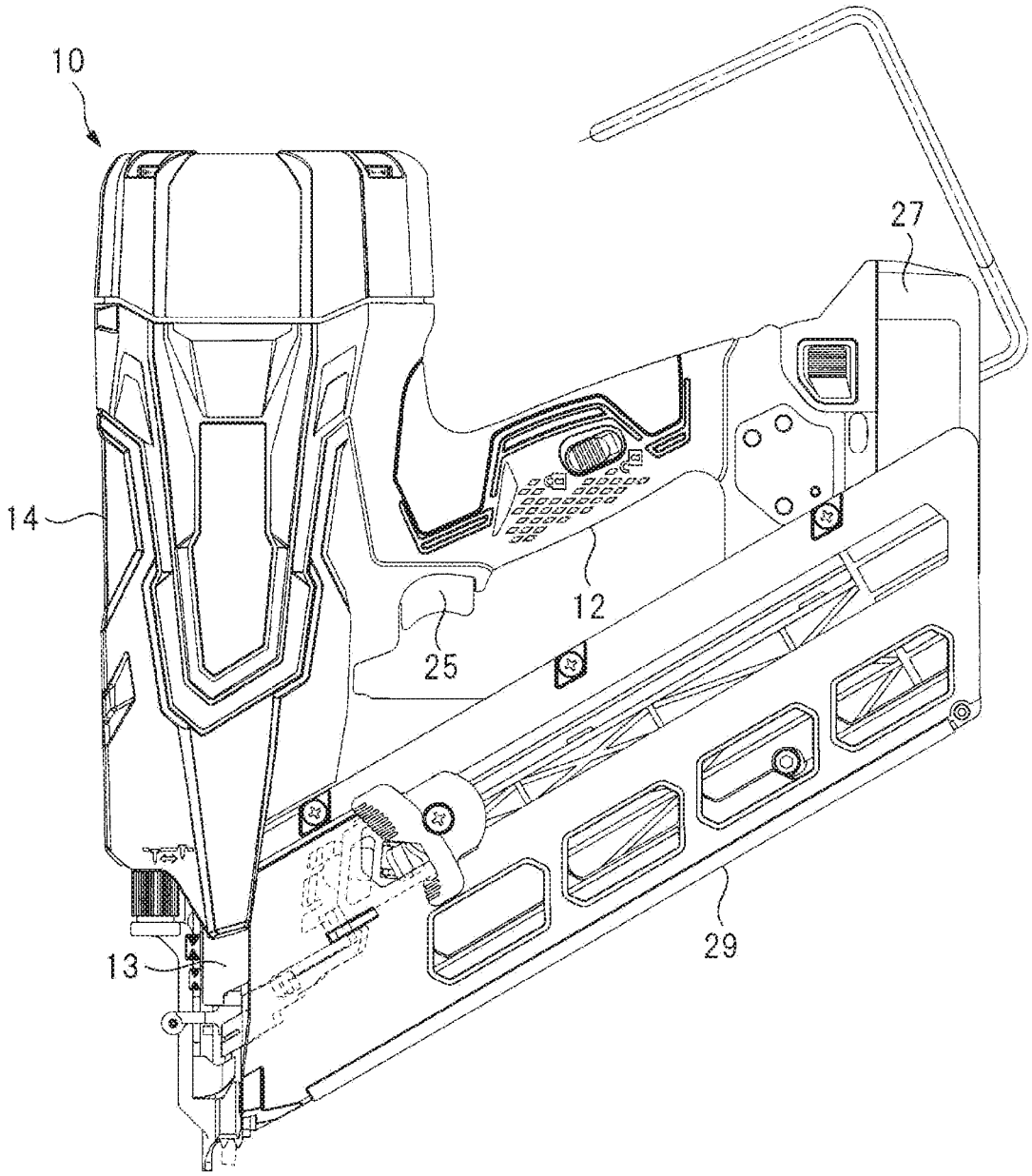
FIG. 3 is a side view showing an outer appearance structure of a lateral side of the driving tool shown in FIG. 1.

Hereinafter, one example of embodiments of the present invention will be explained in detail with reference to the drawings. A driving tool 10 according to the present first embodiment shown in FIGS. 1 to 3 is of the pneumatic type, and is configured so as to drive a fastener in by using a driver blade 21 configuring a striker 22.

A structure of the driving tool 10 is explained to have: a cylindrical cylinder housing 11; a handle 12 that is continuously formed to the cylinder housing 11; and a nose portion 13 fixed to the cylinder housing 11. Further, a cylinder 15, a holder 16 and a pressure accumulator 17 are formed inside the cylinder housing 11, and a piston 18 is arranged so as to be reciprocable inside the cylinder 15. The nose portion 13 is a component forming an injection path 40 that is a path in which the fastener that is driven in by a driver blade 21 goes.

The driving tool 10 further has: a pressure chamber (striking driver) 19 configured to drive the driver blade 21 that strikes the fastener; and a main body 14 with the pressure chamber 19 including the cylinder housing 11. In other words, in the main body 14 of the driving tool 10, the pressure chamber 19 is formed as the striking driver. A sealing member 20 is attached to an outer circumferential surface of the piston 18, and the sealing member 20 is in contact with an inner circumferential surface of the cylinder 15 to form a sealing surface. The sealing member 20 seals the pressure chamber 19. Gas in a compressed state is encapsulated in the pressure chamber 19. The gas encapsulated in the pressure chamber 19 is air, inert gas or others, and, for example, nitrogen gas or rare gas can be also encapsulated therein. In the present first embodiment, an example of the encapsulation of the air in the pressure chamber 19 will be explained.

The piston 18 is movable in a direction of a centerline A1 of the cylinder 15. The piston 18 receives a pressure of the pressure chamber 19 and is urged in the direction of the centerline A1. The driver blade 21 is formed in the piston 18. The driver blade 21 is formed as one body with the piston 18, and the driver blade 21 and the piston 18 configure the striker 22. Each of the driver blade 21 and the piston 18 is made of a metal.

As shown in FIG. 1, a power transmission mechanism 24 is formed inside the nose portion 13. The power transmission mechanism 24 transmits power of an electric motor (motor) 23 to the driver blade 21. A trigger 25 is formed in the handle 12, and a trigger switch 26 is formed inside the handle 12. The trigger switch 26 is turned ON when an operational force is applied to the trigger 25, and is turned OFF when the operational force applied on the trigger 25 is released.

A mounting portion 39 is connected to the handle 12. A battery 27 is attachable to and detachable from the mounting portion 39. The battery 27 supplies electric power to the electric motor 23. The battery 27 is a direct-current power supply.

Note that a case of a nail 28 as the fastener will be explained in the present first embodiment.

As shown in FIG. 3, a magazine 29 that houses the nails (fasteners) 28 shown in FIG. 1 is attached to the nose portion 13. The nails 28 that are housed in the magazine 29 are lined in series. The magazine 29 has a feeding mechanism that feeds the nails 28 to the nose portion 13. As shown in FIG. 2, the magazine 29 is arranged so as to make a predetermined angle θ from the handle 12 of the main body 14. This is for preventing the magazine 29 from interfering with the electric motor 23 shown in FIG. 1. In other words, when the magazine 29 is arranged so as to tilt by the angle θ from a vertical direction, the interference between the magazine 29 and the electric motor 23 can be prevented.

As shown in FIG. 1, a bumper 30 is formed between the cylinder 15 and the nose portion 13. The bumper 30 is monolithically made of a rubber-form elastic body such as elastomer. The bumper 30 is a buffer member that absorbs kinetic energy of the piston 18 when receiving a movement load of the piston 18 and elastically deforming.

The electric motor 23 has a stator 35 that does not rotate with respect to a housing for use in the motor and a rotor 36 that can rotate inside the housing for use in the motor. The electric motor 23 of the present first embodiment is a brushless motor. The rotor 36 is fixed to an output shaft 38, and the output shaft 38 is supported by two bearings 37. The output shaft 38 is rotatable around an axis line A2.

Figure 4:
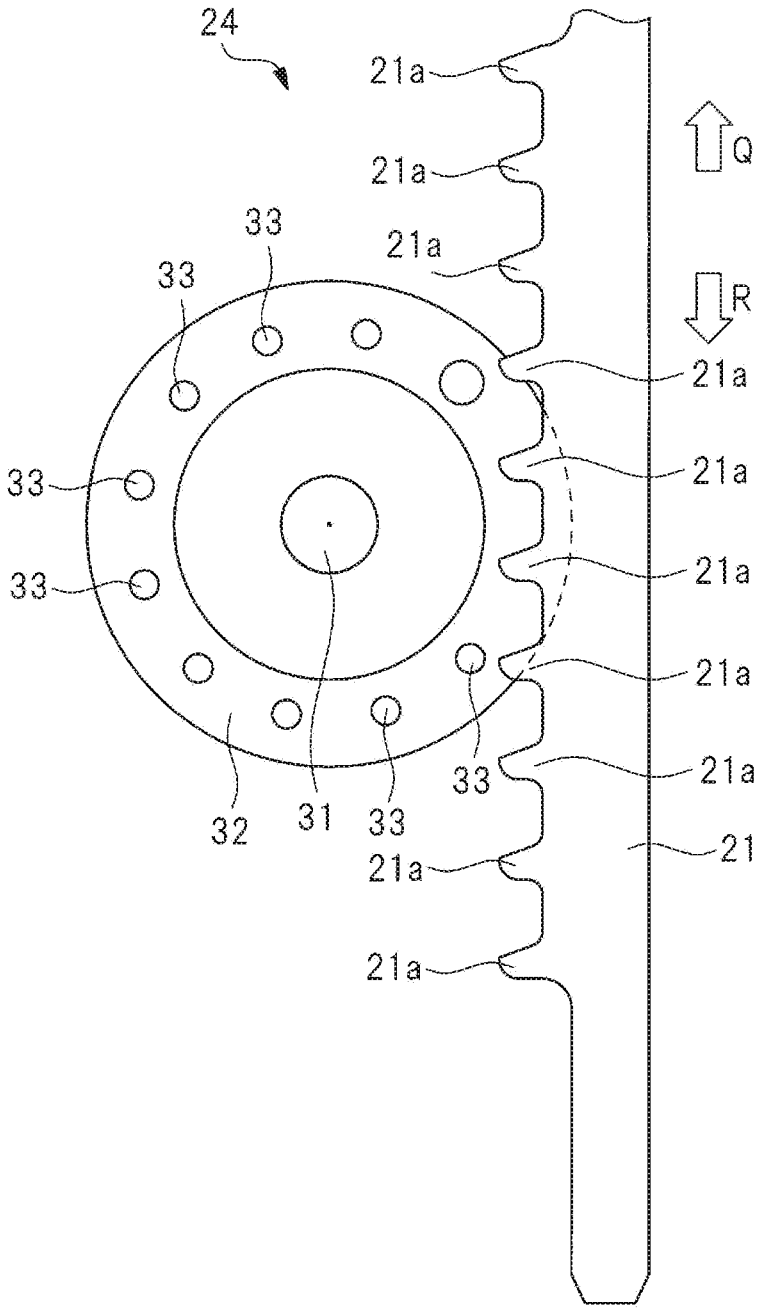
FIG. 4 is a partially-enlarged plan view showing a reeling structure of the driver blade of the driving tool shown in FIG. 1.

The power transmission mechanism 24 shown in FIG. 4 is a conversion mechanism that converts a rotative force of a pin wheel shaft 31 that is a driving shaft into a reciprocating movement force of the driver blade 21. The power transmission mechanism 24 has a pin wheel (rotary plate) 32, a pinion pin (pin) 33 and a protrusion portion 21*a*. The pin wheel 32 is fixed to the pin wheel shaft 31. A plurality of the pinion pins 33 are formed in the pin wheel 32 so as to be along a rotary direction of the pin wheel. A plurality of the protrusion portions 21*a* are formed in the driver blade 21 so as to be along a movement direction of the driver blade.

The pinion pin 33 is engageable with and releasable from the protrusion portion 21*a* of the driver blade 21. When the pinion pin 33 engages with the protrusion portion 21*a* and when the pin wheel 32 rotates counterclockwise in FIG. 4, the driver blade 21 moves in a "Q" direction. When all the pinion pins 33 release from all the protrusion portions 21*a*, the mechanism does not allow the rotative force of the pin wheel 32 to be transmitted to the driver blade 21.

Specifically, a state of the power transform mechanism 24 is switched between the engaging state of the pinion pin 33 of the pin wheel 32 with the protrusion portion 21*a* and the releasing state of the same from the protrusion portion 21*a* by the rotation of the pin wheel 32 due to the driving of the electric motor 23. For example, when the pin wheel 32 rotates counterclockwise and when the pinion pin 33 engages with the protrusion portion 21*a* of the driver blade 21, the rotative force of the pin wheel 32 is transmitted to the driver blade 21, and the driver blade 21 and the piston 18 shown in FIG. 1 move in a direction ("Q" direction) coming close to the pressure chamber 19.

On the other hand, when the pinion pin 33 releases from the protrusion portion 21*a*, the rotative force of the pin wheel 32 is not transmitted to the driver blade 21, and the driver blade 21 and the piston 18 move in a direction ("R" direction) going away from the pressure chamber 19 due to the pressure of the pressure chamber 19.

In other words, in the driving tool 10 of the present first embodiment, the movements of the driver blade 21 in the direction coming close to the pressure chamber 19 and the direction going away from the pressure chamber 19 are made by the engaging/releasing of the plurality of protrusion portions 21*a* formed in the driver blade 21 with/from the plurality of pinion pins 33 included in the rotatable pin wheel 32 formed in the main body 14. Further, the movements are made by the rotation of the pin wheel 32 due to the driving of the electric motor 23 formed in the main body 14.

As described above, in the driving tool 10, the pressure chamber 19 is formed as the striking driver in the main body 14 of the driving tool, and the air that is stored in the pressure chamber 19 is further compressed by the movement of the driver blade 21 toward the pressure chamber 19. When the pinion pins 33 are released from the protrusion portions

21*a*, the compressed air is also released, the driver blade 21 is driven for shot by the releasing of the compressed air, and the nail 28 is driven into a desirable part such as a wood piece.

Next, in the driving tool 10 of the present first embodiment, a structure of the blade guide forming the injection path 40 in which the driver blade 21 moves will be explained.

In the driving tool, the nail jamming in which the nail is jammed in the injection port generally occurs in some cases. The larger the driving energy is, the larger the necessary power for solving the nail jamming is, and therefore, a lot of time and effort for solving the nail jamming are needed so often. Further, in the pneumatic-type driving tool 10, the driver blade 21 is urged by the internal compressed air even in the nail jamming, and therefore, the time and effort for solving the nail jamming tends to increase. The nail jamming is a phenomenon in which a jammed nail 44 is stuck between the driver blade 21 and an inner wall of the injection path 40 as shown in FIG. 5, and the driver blade 21 does not move, either, and therefore, it is difficult to solve the nail jamming.

The driving tool 10 of the present first embodiment has a structure that easily releases the stuck jam nail 44 at the time of the occurrence of the nail jamming.

Figure 5:
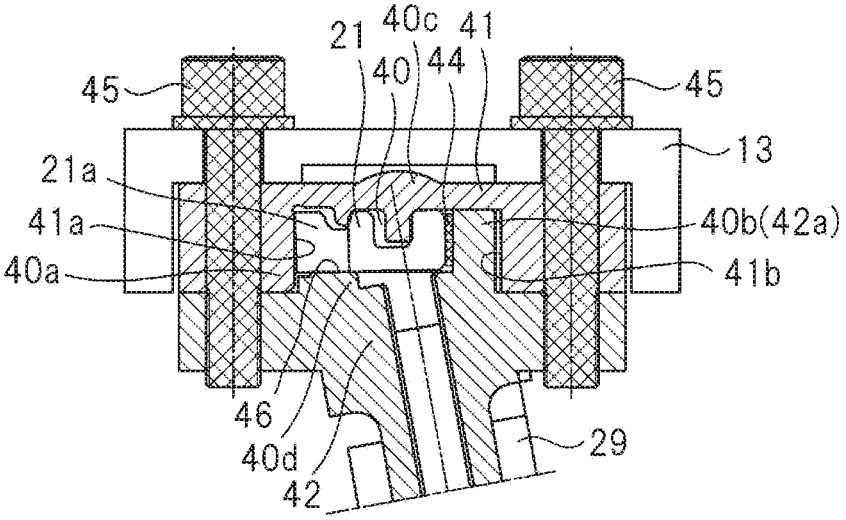
FIG. 5 is a partial cross-sectional view showing a blade-guide attaching structure of the driving tool shown in FIG. 1.

As shown in FIGS. 1 and 5, the driving tool 10 has a first blade guide 41 fixed to the nose portion 13 of the main body 14, and a second blade guide 42 attached to the first blade guide 41 and configured to form the injection path 40 for the nail 28 together with the first blade guide 41. The second blade guide 42 is assembled to the first blade guide 41, and is attached to the nose portion 13 together with the first blade guide 41 by using bolts 45. The driver blade 21 and the injection path 40 that is the path for the nail 28 are made of the first blade guide 41 and the second blade guide 42.

The driver blade 21 is arranged so as to go through the space 46 surrounded by two opposite side walls 40*a* and 40*b* of the injection path 40, a top wall 40*c* and a bottom wall 40*d*.

Figure 6:
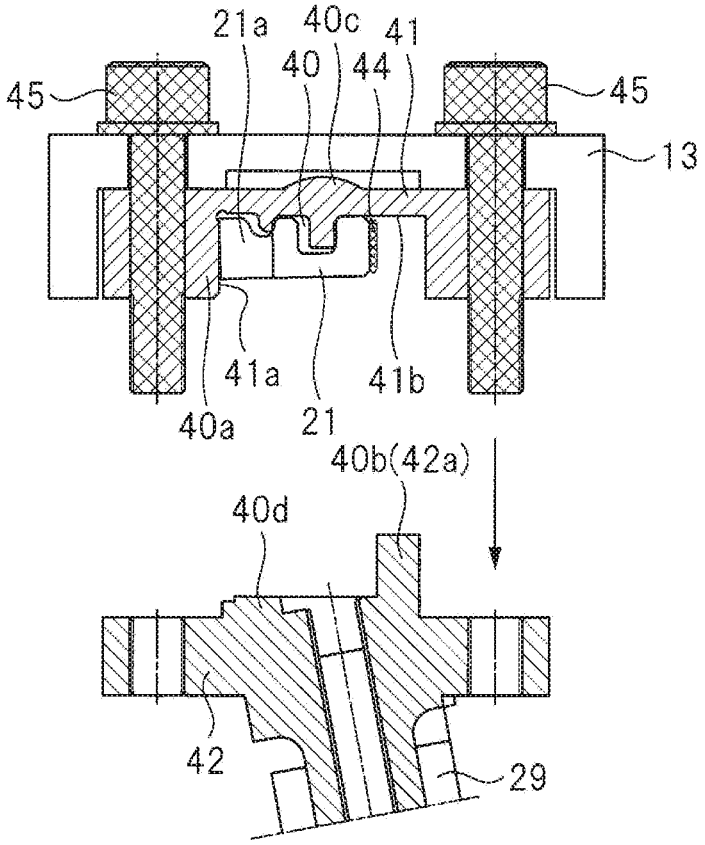
FIG. 6 is a partial cross-sectional view showing the structure shown in FIG. 5, obtained after separation of the blade guide.

As shown in FIG. 6, the driving tool is structured so that either one of the two side walls 40*a* and 40*b* is released from the injection path 40 when the first blade guide 41 and the second blade guide 42 are separated from each other by loosening the two bolts 45.

In the structure shown in FIG. 5, the (one) side wall 40*a* of the two side walls 40*a* and 40*b* is formed as one body with the first blade guide 41, and the (other) side wall 40*b* of the two side walls 40*a* and 40*b* is formed as one body with the second blade guide 42. Further, the top wall 40*c* is formed as one body with the first blade guide 41, and the bottom wall 40*d* is formed as one body with the second blade guide 42.

In more detailed explanation, the side wall 40*a* formed in the first blade guide 41 is a part of the concave portion 41*a* of the first blade guide 41, and the side wall 40*b* formed in the second blade guide 42 is the convex portion 42*a* that protrudes from the second blade guide 42. In this structure, the top wall 40*c* is also a part of the concave portion 41*a* of the first blade guide 41.

In the concave portion 41*a* of the first blade guide 41, a housing portion 41*b* that houses the side wall 40*b* (convex portion 42*a*) formed in the second blade guide 42 is formed.

In the manner, in the structure shown in FIG. 5, when the second blade guide 42 is detached from the first blade guide 41 by loosening the two bolts 45 as shown in FIG. 6, the side wall 40*b* (convex portion 42*a*) formed in the second blade guide 42 separates from the injection path 40. Accordingly, the side wall at which the jam nail 44 is stuck is removed, and therefore, the jam nail 44 can be easily taken out.

In other words, the nail jamming of the driving tool 10 can be easily solved.

The side wall 40*b* that is separated from the injection path 40 when the second blade guide 42 is detached from the first blade guide 41 does not always need to be formed as one body with the second blade guide 42, and may be formed as a body different from the second blade guide 42.

It is only required to arrange the top wall 40*c* and the bottom wall 40*d* so as to be at least separatable from each other, and the side wall 40*b* that separates from the injection path 40 is formed in the bottom wall 40*d*. The side wall 40*a* that does not separate from the injection path 40 may be formed as one body with the top wall 40*c* or may be formed as a body different therefrom.

In the case of the pneumatic-type driving tool, when the nail jamming occurs, the jam nail 44 is stuck between the driver blade 21 and the side wall of the blade guide under a high pressure, and therefore, the jam nail 44 cannot be easily taken out. However, in the driving tool 10 of the present first embodiment, the jam nail 44 can be easily taken out.

In a case of an air-type driving tool, the driver blade 21 can be easily moved by pulling out an air hose. On the other hand, in the case of the pneumatic-type driving tool that always contains the compressed air, it is difficult to move the driver blade 21 toward the pressure chamber 19, and it is not easy to solve the nail jamming. However, in the driving tool 10 of the present first embodiment, the nail jamming can be easily solved in spite of the pneumatic type, and therefore, it is obvious that the driving tool 10 is effective as the pneumatic-type driving tool 10.

Second Embodiment

Figure 7:
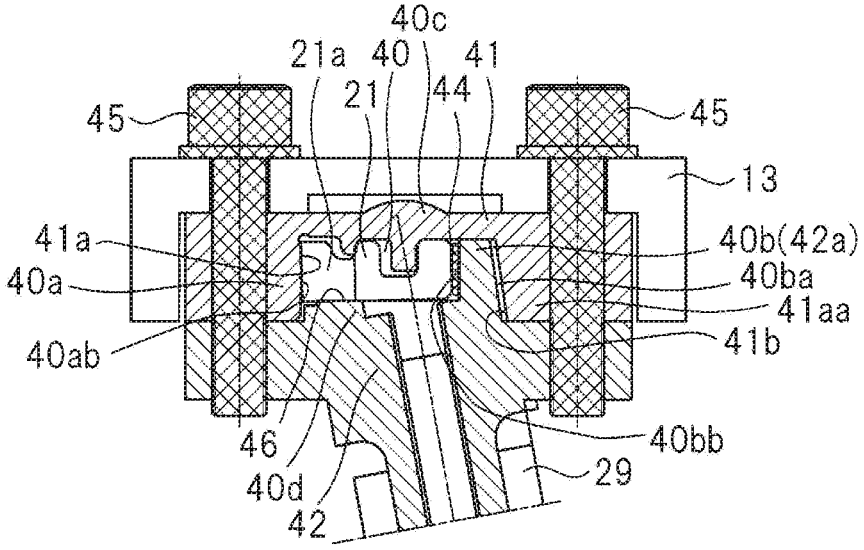
FIG. 7 is a partial cross-sectional view showing a blade-guide attaching structure of a driving tool of a second embodiment of the present invention.

In the present second embodiment, as shown in FIG. 7, the side wall 40*b* that is formed as one body with the second blade guide 42 becomes thinner toward the first blade guide 41 (An outer wall surface 40*ba* of the side wall 40*b* of the second blade guide 42 is formed so that its distance from an inner wall surface 40*bb* of the side wall 40*b* becomes gradually larger toward a setting position of the magazine 29). For example, the outer wall surface 40*ba* of the side wall 40*b* is formed at the same angle as a setting tilt angle of the magazine 29 so as to be parallel to the magazine 29 (which means that the wall surface 40*ba* becomes a tilted surface).

Figure 8:
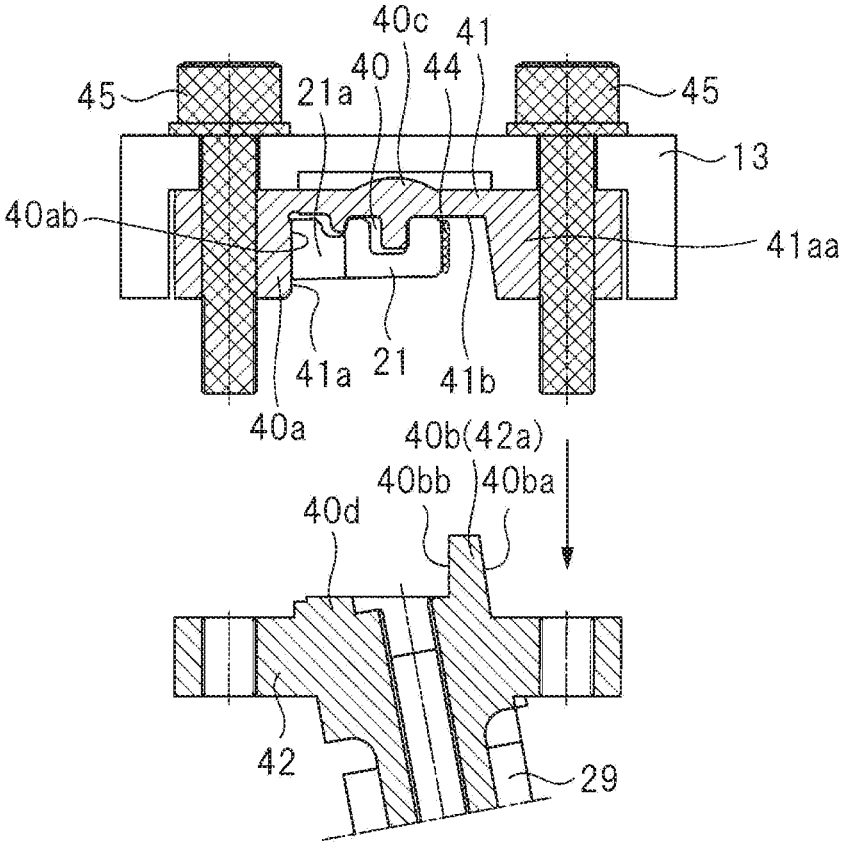
FIG. 8 is a partial cross-sectional view showing the structure shown in FIG. 7, obtained after separation of the blade guide.

Since the outer wall surface 40*ba* of the side wall 40*b* that separates from the injection path 40 is the tilted surface as described above, a horizontal-directional component force is generated by a tilt component of the wall surface 40*ba* when the second blade guide 42 is detached from the first blade guide 41 as shown in FIG. 8, so that the wall surface 40*ba* easily separates from the side wall 41*aa* of the concave portion 41*a* of the first blade guide 41.

Therefore, the second blade guide 42 can be more easily detached from the first blade guide 41.

Third Embodiment

Figure 9:
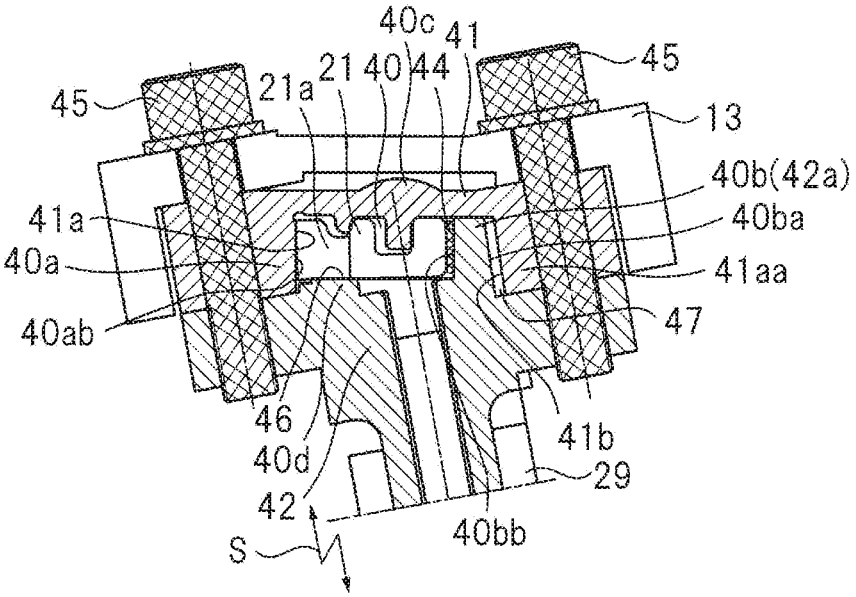
FIG. 9 is a partial cross-sectional view showing a blade-guide attaching structure of a driving tool of a third embodiment of the present invention.

In the present third embodiment, as similar to the second embodiment, as shown in FIG. 9, the side wall 40*b* that is formed as one body with the second blade guide 42 becomes thinner toward the first blade guide 41 (An outer wall surface 40*ba* of the side wall 40*b* of the second blade guide 42 is formed so that its distance from an inner wall surface 40*bb* of the side wall 40*b* becomes gradually larger toward a setting position of the magazine 29). For example, the outer wall surface 40*ba* of the side wall 40*b* is formed at the same angle as a setting tilt angle of the magazine 29 so as to be parallel to the magazine 29.

Figure 10:
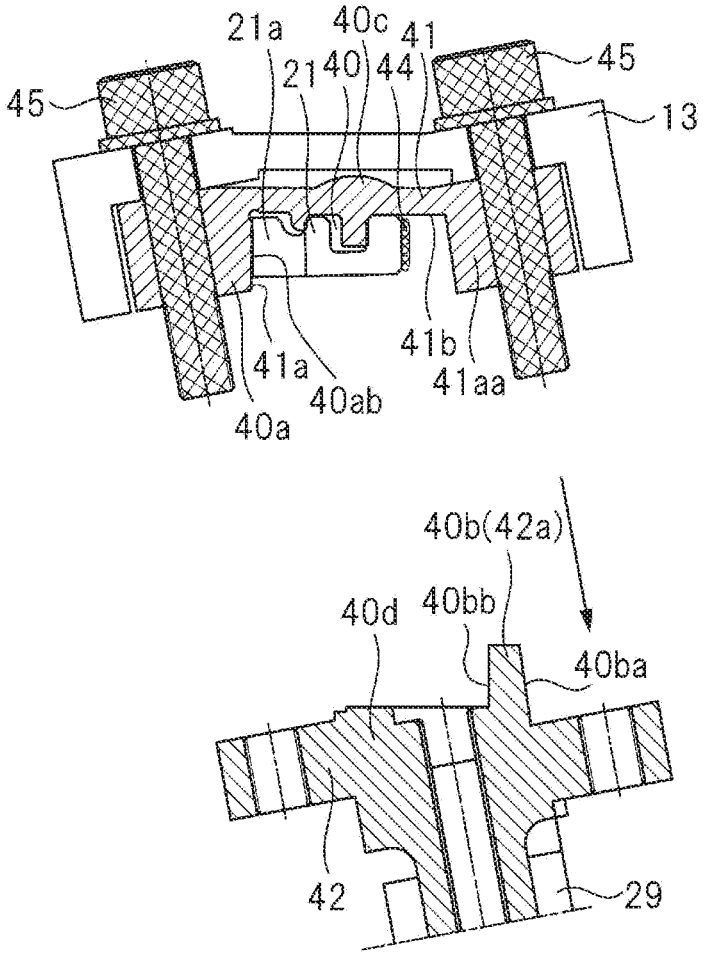
FIG. 10 is a partial cross-sectional view showing the structure shown in FIG. 9, obtained after separation of the blade guide.

In the manner, as similar to the second embodiment, as shown in FIG. 10, a horizontal-directional component force is generated by a tilt component of the wall surface 40*ba* when the second blade guide 42 is detached from the first blade guide 41, so that the wall surface 40*ba* easily separates from the side wall 41*aa* of the concave portion 41*a* of the first blade guide 41.

Further, in the structure of the present third embodiment, a clearance 47 shown in FIG. 9 is formed between the outer wall surface 40*ba* of the side wall 40*b* and the side wall 41*aa* of the concave portion 41*a* of the first blade guide 41 opposite to this wall surface 40*ba*.

In the manner, a space is formed in a portion of the stuck jam nail when the bolts 45 are loosened, and the space between the wall surface 40*ba* and the side wall 41*aa* is enlarged at the beginning of the loosening of the bolts 45, and therefore, the second blade guide 42 can be more easily detached from the first blade guide 41.

Further, in the structure of the present third embodiment, the first blade guide 41 and the second blade guide 42 are attached so as to be parallel to the outer wall surface 40*ba* of the side wall 40*b* that separates from the injection path 40. For example, the first blade guide 41 and the second blade guide 42 are attached at an angle causing the blade guides to be parallel to an extension direction "S" of the magazine 29 shown in FIG. 9. The second blade guide 42 is detachable from the first blade guide 41.

Specifically, the second blade guide 42 is joined to the magazine 29 that houses the plurality of nails 28, and the first blade guide 41 and the second blade guide 42 are attached so as to be parallel to the extension direction "S" of the magazine 29.

In other words, in the structure of the present third embodiment, both the first blade guide 41 and the second blade guide 42 are attached by the two bolts 45 so as to be parallel to the outer wall surface 40*ba* of the side wall 40*b*. At this time, the two bolts 45 are also attached at the same angle as those of the two blade guides. Therefore, in one example, the first blade guide 41, the second blade guide 42 and the two bolts 45 are attached to the nose portion 13 so as to be parallel to the extension direction "S" of the magazine 29.

In the manner, a slide direction of the second blade guide 42 in the detachment tilts from a contact portion between the jam nail 44 and the inner wall surface 40*bb* of the side wall 40*b* so as to be a direction going away from the jam nail 44, and therefore, the second blade guide 42 is easy to slide. In other words, the second blade guide 42 is easily detached.

As a result, the second blade guide 42 can be more easily detached from the first blade guide 41.

Fourth Embodiment

Figure 11:
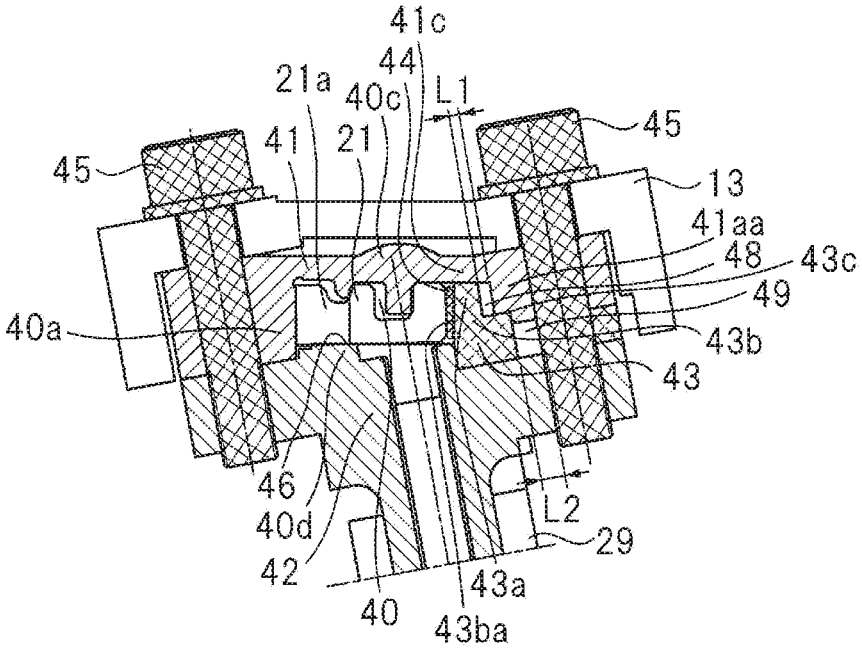
FIG. 11 is a partial cross-sectional view showing a blade-guide attaching structure of a driving tool of a fourth embodiment of the present invention.

In a structure of the present fourth embodiment, as shown in FIG. 11, the (one) side wall 40*a* of the two side walls forming the injection path 40 is formed in the first blade guide 41, and the other of the two side walls is formed as a body different from the first blade guide 41 and the second blade guide 42. Specifically, the other side wall that separates from the injection path 40 is a third blade guide 43 that is imposed between the first blade guide 41 and the second blade guide 42. A cross-sectional shape of the third blade guide 43 is an L shape.

In other words, in the structure of the present fourth embodiment, as shown in FIG. 11, the injection path 40 is made of the side wall 40*a* of the first blade guide 41, the top wall 40*c* of the first blade guide 41, the bottom wall 40*d* of the second blade guide 42, and the third blade guide 43 arranged between the first blade guide 41 and the second blade guide 42.

The third blade guide 43 has an engaging portion 43*a* that engages with an engaging portion 41*c* that is formed in the first blade guide 41, the engaging portion 43*a* being near the side wall and the engaging portion 41*c* being near the first blade guide. In the manner, when the second blade guide 42 is attached to the first blade guide 41, the engaging portion 43*a* near the side wall and the engaging portion 41*c* near the first blade guide engage with each other to form the side wall 43*b* of the injection path 40. When the first blade guide 41 and the second blade guide 42 are separated from each other, the engaging between the engaging portion 43*a* near the side wall and the engaging portion 41*c* near the first blade guide is canceled.

As shown in FIG. 11, in the structure in which a corner engaging portion 43*c* of the third blade guide 43 engages with the first blade guide 41 when the second blade guide 42 is attached to the first blade guide 41, a clearance 48 between the third blade guide 43 and the first blade guide 41 and a clearance 49 between the third blade guide 43 and the bolt 45 are formed. At this time, a width L2 of the clearance 49 is larger than a width L1 of the clearance 48 (L2>L1).

Figure 12:
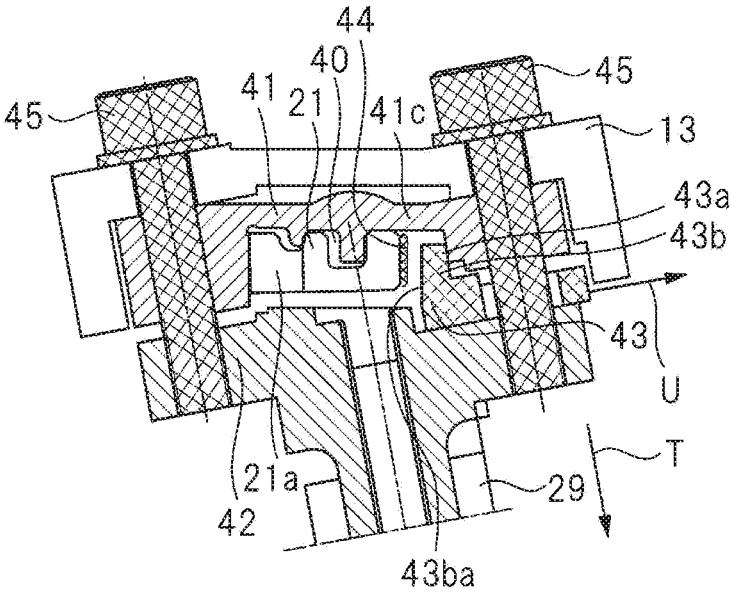
FIG. 12 is a partial cross-sectional view showing the structure shown in FIG. 11, obtained after separation of the blade guide.

In the manner, as shown in FIG. 12, when the bolts 45 are loosened, the second blade guide 42 moves downward (in a "T" direction), and the third blade guide 43 moves in a lateral direction (in a "U" direction). In other words, a hole diameter of a screw hole into which the bolt 45 is screwed in the third blade guide 43 is formed to be large, and therefore, when the bolts 45 are loosened, the third blade guide 43 moves downward (in the T direction) because of a weight itself, and easily moves in the lateral direction (in the U direction).

Therefore, when the bolts 45 are loosened, the third blade guide 43 can easily move in a direction going away from the jam nail 44.

In the structure of the present fourth embodiment, as similar to the third embodiment, as shown in FIGS. 11 and 12, the first blade guide 41 and the second blade guide 42 are attached so as to be, for example, parallel to the extension direction "S" of the magazine 29 shown in FIG. 9. Specifically, the second blade guide 42 is joined to the magazine 29 that houses the plurality of nails 28, and the first blade guide 41 and the second blade guide 42 are attached at the angle that makes the blade guides parallel to the extension direction "S" of the magazine 29.

In other words, also in the present fourth embodiment, each of the first blade guide 41 and the second blade guide 42 is attached at the angle that makes each blade guide parallel to the magazine 29, and the two bolts 45 are also attached at the same angle as those of the two blade guides. Note that the first blade guide 41, the second blade guide 42 and the two bolts 45 are attached to the nose portion 13 so as to be parallel to the extension direction "S" of the magazine 29 in one example.

In the manner, as similar to the third embodiment, as shown in FIG. 12, the slide direction of the second blade guide 42 in the detachment is the direction going away from the contact portion between the jam nail 44 and the inner wall surface 43*ba* of the side wall 43*b*, and therefore, the second blade guide 42 easily slides. In other words, the second blade guide 42 is easily detached.

As a result, the second blade guide 42 can be more easily detached from the first blade guide 41.

As described above, the jam nail 44 can be more easily taken out in the structure of the present fourth embodiment than the structures of the first to third embodiments, and the nail jamming can be more easily solved.

In the structure of the present fourth embodiment, the third blade guide 43 is formed as the body different from the first blade guide 41 and the second blade guide 42. Therefore, when the third blade guide 43 is made of a material having a hardness that is higher than those of materials of the first blade guide 41 and the second blade guide 42, wall damage due to wearing against the jam nail 44 can be suppressed. In the manner, quality of the driving tool 10 can be improved.

The present invention is not limited to the foregoing embodiments, and various modifications can be made within the scope of the present invention. For example, in the first to fourth embodiments, the explanation has been made for the case of the mechanism using the pin wheel as the reeling mechanism of the drier blade 21. However, as the reeling mechanism of the driver blade 21, a reeling mechanism using a wire may be applicable.

EXPLANATION OF REFERENCE CHARACTERS

10 . . . driving tool, 11 . . . cylinder housing, 13 . . . nose portion, 14 . . . main body, 15 . . . cylinder, 18 . . . piston, 19 . . . pressure chamber (striking driver), 21 . . . driver blade, 23 . . . electric motor (motor), 28 . . . nail (fastener), 29 . . . magazine, 31 . . . pin wheel shaft, 32 . . . pin wheel (rotary plate), 33 . . . pinion pin (pin), 40 . . . injection path, 41 . . . first blade guide, 42 . . . second blade guide, 43 . . . third blade guide, 46 . . . space

The invention claimed is:

1. A driving tool comprising:

a striking driver configured to drive a driver blade that strikes a fastener;

a main body having the striking driver;

a first blade guide fixed to the main body; and a second blade guide attached to the first blade guide and configured to form an injection path for the fastener together with the first blade guide, wherein the driver blade is arranged so as to go through the injection path surrounded by first and second opposite side walls of the injection path, a bottom wall and a top wall, wherein one of the first blade guide and the second blade guide has a concave portion, and another of the first blade guide and the second blade guide has a convex portion that positions inside the concave portion, wherein one of the first and second opposite side walls is a part of the concave portion, and another one of the first and second opposite side walls is a part of the convex portion that positions inside the concave portion, wherein one of the bottom wall and the top wall is detachable from both of the injection path and another one of the bottom wall and the top wall, and wherein the first opposite side wall is detachable from both of the injection path and the second opposite side wall.

2. The driving tool according to claim 1, wherein the top wall is formed in the first blade guide, and wherein the bottom wall is formed in the second blade guide.

3. The driving tool according to claim 1, wherein the convex portion becomes thinner toward the first blade guide.

4. The driving tool according to claim 1, wherein the first blade guide and the second blade guide are formed so as to be parallel to an outer wall surface of the first opposite side wall that is separated from the injection path, and wherein the second blade guide is formed to be detachable from the first blade guide.

5. The driving tool according to claim 4, wherein the second blade guide is joined to a magazine configured to house a plurality of fasteners, and wherein the first blade guide and the second blade guide are attached so as to be parallel to an extension direction of the magazine.

6. The driving tool according to claim 1, wherein a pressure chamber is formed as the striking driver in the main body, gas that is stored in the pressure chamber is further compressed by movement of the driver blade toward the pressure chamber, and the driver blade is driven for shot by releasing the compressed gas.

7. The driving tool according to claim 6, wherein the movement of the driver blade is made by: engaging of a plurality of protrusions provided on the driver blade with a plurality of engaging parts of a rotary plate provided in the main body so as to be rotatable, and rotating the rotary plate due to driving of a motor formed in the main body.

8. A driving tool comprising:

a striking driver configured to drive a driver blade that strikes a fastener;

a main body having the striking driver;

a first blade guide fixed to the main body; and a second blade guide attached to the first blade guide and configured to form an injection path for the fastener together with the first blade guide, wherein the driver blade is arranged so as to go through the injection path surrounded by two opposite side walls of the injection path, a bottom wall and a top wall, wherein one of the first blade guide and the second blade guide has a concave portion, and another of the first blade guide and the second blade guide has a convex portion that positions inside the concave portion, wherein one of the two opposite side walls is a part of the concave portion, and another one of the two opposite side walls is a part of the convex portion that positions inside the concave portion, and wherein when the second blade guide is separated from the first blade guide, (1) a distance between the bottom wall and the top wall becomes greater than before separating the second blade guide from the first blade guide, and (2) a distance between the two opposite side walls becomes greater than before separating the second blade guide from the first blade guide.

* * * * *